United States Patent [19]

Liang

[11] 4,383,186

[45] May 10, 1983

[54] ELECTRICAL SWITCHING APPARATUS

[76] Inventor: Christopher Liang, 2573 Hallmark, Belmont, Calif. 94002

[21] Appl. No.: 349,464

[22] Filed: Feb. 17, 1982

[51] Int. Cl.[3] ..... H01H 47/00

[52] U.S. Cl. ..... 307/113

[58] Field of Search ..... 307/113, 115; 315/362

[56] References Cited

U.S. PATENT DOCUMENTS

| | | | |
|---|---|---|---|
| 3,697,821 | 10/1972 | Johnson | 307/115 X |
| 3,860,910 | 1/1975 | Hudson | 307/113 X |
| 4,181,844 | 1/1980 | Moretto | 307/115 X |

FOREIGN PATENT DOCUMENTS

| | | | |
|---|---|---|---|
| 1232953 | 5/1971 | United Kingdom | 307/113 |

*Primary Examiner*—Donald A. Griffin

*Attorney, Agent, or Firm*—T. H. P. Richardson

[57] ABSTRACT

Electrical switching apparatus comprises first and second plugs, each with a lead attached thereto, and a load socket which is connected to the second plug through a switching assembly. The first plug is connected to a wall socket controlled by a remote switch. The second plug is connected to a permanently live wall socket. The switching assembly comprises two switches, one operated by adjacent manual control means, the other being an electromagnetic relay operated, via the first plug and lead, by the remote switch. Each of the switches in the switching assembly has first and second positions. When each switch is in its first position, and when each switch is in its second position, the load socket is connected to the live wall socket. When one switch is in its first position and the other in its second position, the load socket is disconnected. In this way the load socket can be connected or disconnected by operating either the remote switch or the adjacent manual control means.

8 Claims, 3 Drawing Figures

ELECTRICAL SWITCHING APPARATUS

FIELD OF THE INVENTION

This invention relates to electrical switching apparatus.

INTRODUCTION TO THE INVENTION

In many buildings, the electrical wiring is arranged so that at least one of the wall sockets in a room is controlled by a switch at the entrance to the room, with the primary intention that a lamp or other appliance plugged into the socket can be switched on or off when entering or leaving the room. Although this is a useful arrangement, it suffers from disadvantages. If the lamp has no switch on it, the entrance switch must be used to turn the lamp on and off. If the lamp also has a switch on it (or near it), the lamp is lit only when both switches are on. The operation of Murphy's law ensures that the convenient switch is often not the one which will turn the lamp on. It is not only inconvenient, but can also be dangerous, especially for those who are old or ill, to have to cross a dark room in order to reach the switch which will turn on the light. The arrangement is also wasteful of energy, since lamps are often left on in order to avoid the inconvenience and possible danger of crossing a dark room to reach the right switch.

SUMMARY OF THE INVENTION

I have discovered a novel switching apparatus which substantially overcomes the disadvantage noted above, and does so at modest cost and with complete reliability. The invention makes use of a switching assembly which is placed in a lead which connects a live outlet socket and the lamp (or other appliance) and which is also connected to the outlet socket controlled by the entrance switch.

The apparatus of the invention comprises (1) a first plug connectable to the first power socket which can be switched on or off by a remote switch which is manually operated at a location remote from the socket;

(2) a first electrical lead connected to the first plug;

(3) a second plug connectable to a second power socket which is normally switched on;

(4) a second electrical lead connected to the second plug; and (5) a load socket which is connectable to an electrical load, e.g. a lamp, and to which the second lead is connected through (6) a switching assembly which comprises (a) a first conductor;

(b) a second conductor;

(c) a first switch which has a first position wherein it is connected to the first conductor and disconnected from the second conductor and a second position wherein it is connected to the second conductor and disconnected from the first conductor;

(d) a first switch-controlling means which is associated with the first switch and with the first lead, whereby when the first plug is connected to the first power socket, the first switch is in its first position when the first power socket is on and in its second position when the first power socket is off;

(e) a second switch which has a first position wherein it is connected to the first conductor and disconnected from the second conductor and a second position wherein it is connected to the second conductor and disconnected from the first conductor; and (f) a second switch-controlling means which is adjacent to the second switch and which can be manually operated to move the second switch between its first and second positions whereby, when the first plug is connected to the first power socket, the second plug is connected to the second power socket and the electrical load is connected to the load socket, the load can be connected to or disconnected from the second power socket either by operating the remote switch or by operating the second switch-controlling means.

BRIEF DESCRIPTION OF THE DRAWINGS

The invention is illustrated in the accompanying drawings, in which.

DETAILED DESCRIPTION OF THE INVENTION

Figure 1:
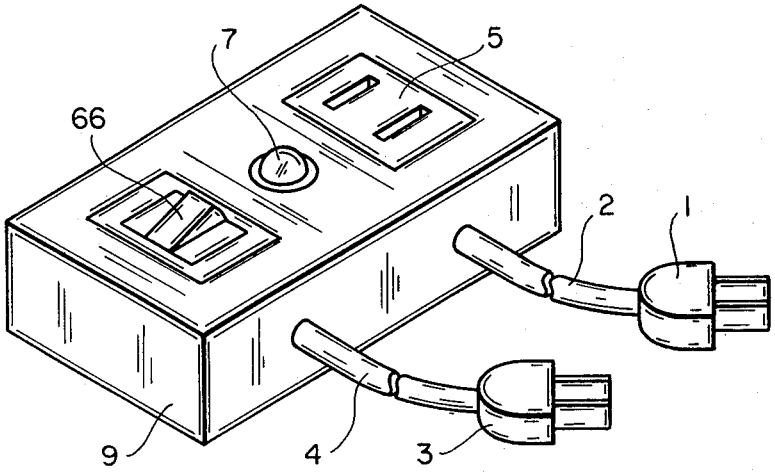
FIG. 1 is a sketch of the apparatus of the invention.

The second switch and second switch-controlling means can be provided by a simple toggle switch, but any form of manually operated switch can be employed. The first switch and first switch-controlling means are preferably provided by a relay and an associated electromagnet which is powered by the first lead; however, other forms of remotely-operated switch can be used.

The power sockets to which the first and second plugs are connected can be powered by the same power source or by different power sources. Suitable power sources include both AC and DC power sources. The leads and other electrical components will of course be chosen according to the power source to be used. Often both power sockets will be connected to the same 120 volt AC power source.

The switching assembly can conveniently be contained in an insulating housing having the first and second electrical leads extending from it and having the second switch-controlling means accessible from the outside of it. The insulating housing can comprise means for fixing it to a surface, e.g. a wall or table top. The load socket is preferably mounted in the insulating housing, but can alternatively be connected to it by a third electrical lead extending from the housing.

The apparatus can also comprise a small neon light which is connected across the conductors of the second electrical lead and which is, therefore, lit when the second plug is connected to the second power socket. The neon light is preferably placed on the insulating housing adjacent to the second switch-controlling means so that the latter can easily be located in the dark.

The invention will now be described by reference to the accompanying drawings. It is to be understood, however, that the invention is not limited to the particular embodiments in the drawings.

As illustrated in FIG. 1, the apparatus of the invention comprises a first plug 1 having a first lead 2 attached to it and a second plug 3 having a second lead 4 attached to it. The leads 2 and 4 pass into a housing 9 which is made of insulating material, e.g. plastics material. Mounted in the top of the housing are a load socket 5, lever 66 of a toggle switch, and a neon light 7. Within the housing 9 (but not shown in FIG. 1) is a switching assembly as defined above and as further described below in connection with FIG. 3.

Figure 2:
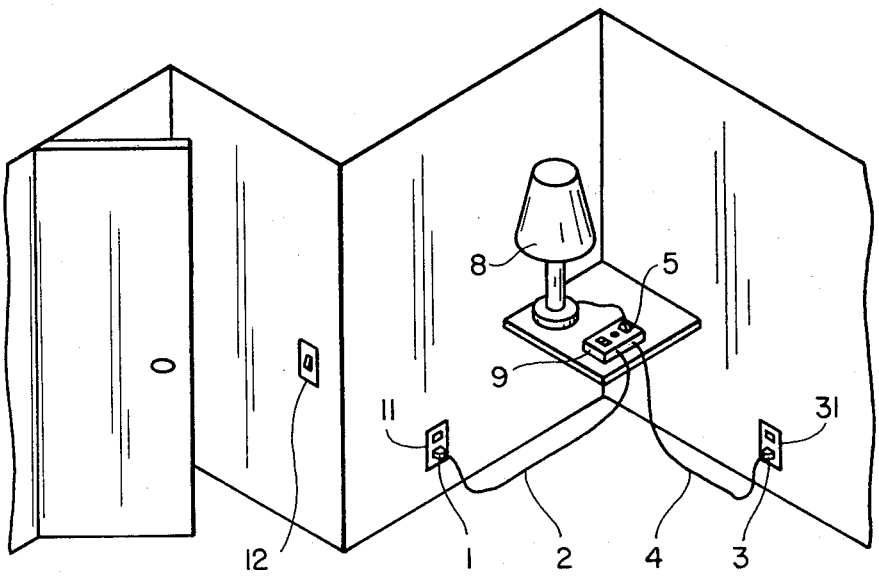
FIG. 2 is a sketch of the apparatus of FIG. 1 installed in a room.

FIG. 2 shows the apparatus of FIG. 1 installed in a room. The first plug 1 is connected to a first power socket 11 which is connected to, or disconnected from, a 120 volt AC power supply by means of toggle switch 12 at the entrance to the room. The second plug 3 is connected to a second power socket 31 which is permanently connected to a 120 volt AC power supply. A lamp 8 is connected to the load socket 5.

Figure 3:
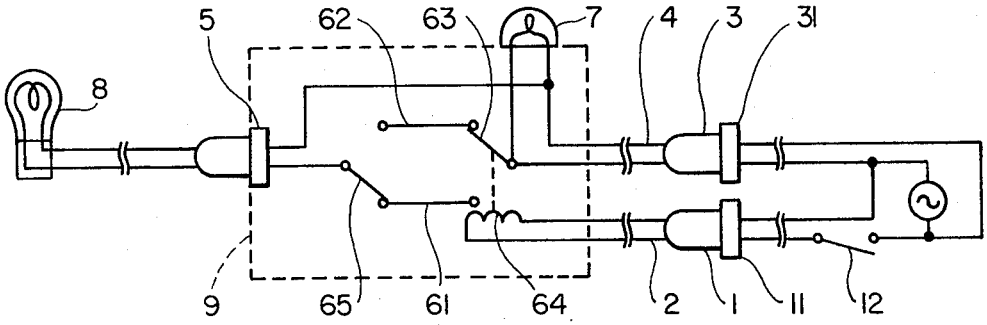
FIG. 3 is an electrical circuit diagram of the sketch of FIG. 2.

FIG. 3 shows the circuit which results from connection of the apparatus of FIG. 1 in the way shown in FIG. 2. The various components shown in FIGS. 1 and 2 are also shown in FIG. 3, and in addition FIG. 3 shows the switching assembly within the housing 9. The switching assembly includes conductors 61 and 62, and a relay 63 which is biassed so that it contacts conductor 62 when switch 12 is open (as shown in FIG. 3). When switch 12 is closed, however, current passing through electromagnet 64 causes the relay to move so that it contacts conductor 61. The switching assembly also includes switch 65 which is controlled by lever 66 so that it contacts either conductor 62 or conductor 61.

When the switches 63 and 65 are in the position shown, the lamp 8 is not lit. It can, however, be lit by operating the lever 66 (which moves the switch 65 so that it contacts conductor 62) or by closing the remote switch 12, which activates electromagnet 64 and thus causes the switch 63 to contact conductor 61. The lamp can then be turned off again by operating the lever 66 or by opening the remote switch 12.

I claim:

1. Electrical switching apparatus which can be easily connected to and disconnected from existing sockets in conventional electrical wiring of a building, and which comprises (1) a first plug connectable to a first power socket which can be switched on or off by a remote switch which is manually operated at a location remote from the socket;

(2) a first electrical lead connected to the first plug;

(3) a second plug connectable to a second power socket which is normally switched on;

(4) a second electrical lead connected to the second plug; and (5) a load socket which is connectable to an electrical load and to which the second lead is connected through;

(6) a switching assembly which comprises (a) a first conductor;

(b) a second conductor;

(c) a first switch which has a first position wherein it is connected to the first conductor and disconnected from the second conductor and a second position wherein it is connected to the second conductor and disconnected from the first conductor;

(d) a first switch-controlling means which is associated with the first switch and with the first lead, whereby when the first plug is connected to the first power socket, the first switch is in its first position when the first power socket is on and in its second position when the first power socket is off;

(e) a second switch which has a first position wherein it is connected to the first conductor and disconnected from the second conductor and a second position wherein it is connected to the second conductor and disconnected from the first conductor; and (f) a second switch-controlling means which is adjacent to the second switch and which can be manually operated to move the second switch between its first and second positions whereby, when the first plug is connected to the first power socket, the second plug is connected to the second power socket and the electrical load is connected to the load socket, the load can be connected to or disconnected from the second power socket either by operating the remote switch or by operating the second switch-controlling means.

2. Apparatus according to claim 1 wherein the switching assembly is contained within an insulating housing having the first and second electrical leads extending from it and having the second switch-controlling means accessible from the outside of it.

3. Apparatus according to claim 2 wherein the load socket is mounted in the insulating housing.

4. Apparatus according to claim 1 wherein the first switch is a relay and the first switch-controlling means is an electromagnet.

5. Apparatus according to claim 1 which further comprises (7) a neon light connected across the conductors of the second electrical lead, whereby the neon light is lit when the second plug is connected to the second power socket.

6. Apparatus according to claim 1 wherein the first plug is connected to a first power socket which can be switched on or off by a remote switch which is manually operated at a location remote from the socket and the second plug is connected to a second power socket which is normally switched on.

7. Apparatus according to claim 1 which further comprises (8) a lamp which is connected to the load socket.

8. Apparatus according to claim 1 which is suitable for use with a 120 volt AC power source.

* * * * *